United States Patent [19]

Nguyen

[11] Patent Number: 4,549,589

[45] Date of Patent: Oct. 29, 1985

[54] CAMERA CASE

[76] Inventor: Tan V. Nguyen, 4465 Missippi St., #5, San Diego, Calif. 92116

[21] Appl. No.: 618,081

[22] Filed: Jun. 7, 1984

[51] Int. Cl.[4] ..... A45C 11/38

[52] U.S. Cl. ..... 150/52 J; 266/316; 266/810; 383/97

[58] Field of Search ..... 150/52 J; 383/97; 206/316, 810

[56] References Cited

U.S. PATENT DOCUMENTS

| | | | |
|---|---|---|---|
| Re. 17,118 | 10/1928 | Granger | 383/97 X |
| 2,323,053 | 6/1943 | Kupferschmid | 150/52 J |
| 3,295,576 | 1/1967 | Schmitt et al. | 150/52 J |
| 3,443,671 | 5/1969 | Dyke | 383/97 X |
| 3,726,239 | 4/1973 | Dean | 383/97 X |
| 4,136,726 | 1/1979 | Lee | 150/52 J |
| 4,162,696 | 7/1979 | Sprung | 150/52 J |
| 4,172,485 | 10/1979 | Mathieu | 150/52 J |
| 4,176,701 | 12/1979 | Welgan | 150/52 J |

FOREIGN PATENT DOCUMENTS

| | | | |
|---|---|---|---|
| 1155321 | 10/1963 | Fed. Rep. of Germany | 150/52 J |
| 1249147 | 11/1960 | France | 383/97 |
| 1319363 | 1/1963 | France | 150/52 J |
| 502130 | 11/1954 | Italy | 150/52 J |
| 2037150 | 7/1980 | United Kingdom | 150/52 J |
| 2084866 | 4/1982 | United Kingdom | 206/316 |

*Primary Examiner*—William Price
*Assistant Examiner*—Sue A. Weaver
*Attorney, Agent, or Firm*—Baker, Maxham, Callan & Jester

[57] ABSTRACT

A case for holding an interchangeable lens camera comprises at least three parts which can be interconnected in various ways to provide different camera and lens holding arrangements. A first part of the case is arranged to fit over the main body of a camera case and has a central opening through which a camera lens projects. The other two parts are cylinders, each open at one end, which fit over two camera lenses. Interengageable connectors such as zippers are provided around the opening of the first part, the open ends of the cylinders, and the closed end of one of the cylinders. Thus the case can be arranged to carry a camera and two lenses by securing one of the cylinders to the opening or the first part to hold the camera and one of the lenses, and securing the other cylinder to the closed end of the first cylinder to carry another lens. Alternatively the two cylinders can be secured together to form a closed cylinder to carry either a lens or the first part of the case when not in use. If the cylinders are made of different lengths one can be used to carry a telescopic lens and the other used to carry a standard lens.

8 Claims, 4 Drawing Figures

CAMERA CASE

BACKGROUND OF THE INVENTION

The present invention relates to a case for protecting an interchangeable lens camera, particularly a 35 mm. camera, when not in use.

Camera cases for such cameras are normally arranged to cover the whole body of a camera fitted with a standard lens. Extra lenses must be carried separately. Standard camera cases are often awkward to remove and replace.

SUMMARY OF THE INVENTION

It is an object of the present invention to provide a camera case which can hold an interchangeable lens camera fitted with any lens of any size or length, or in various arrangements can hold two lenses.

It is a further object of the invention to provide a collapsible camera case which is easy to remove and replace, and which can be stored compactly when not in use.

According to the present invention a camera case is provided which comprises at least three releasably connected parts, including a first part shaped to releasably hold a camera body and having a central opening through which a camera lens can project, and second and third cylindrical parts each designed to hold a camera lens. The cylindrical parts are each open at one end. Interengageable connecting means are provided around the opening of the first part, the open ends of the cylindrical parts, and the closed end of the second cylindrical part, such that the parts can be selectively interengaged together.

The arrangement is preferably such that either end of the second cylindrical part can be secured to the open end of the third cylindrical part, and the second cylindrical part can be secured to the opening in the first part.

The various parts of the case can be secured together to store or carry a camera fitted with one lens and a separate lens, as one body. The first part of the case is placed around the camera body so that the fitted lens projects through its opening. The second cylindrical part is placed over the lens and its open end is attached to the opening in the first part. Another third lens is placed in the shorter cylindrical part, which is then secured at its open end to the closed end of the second cylindrical part. Thus the camera and lenses can be stored or carried as one body, reducing the risks of losing or damaging a lens.

When the camera is used with one of the lenses, another lens can be stored for safety in a cylindrical enclosure formed by securing the open ends of the cylindrical parts together. The same cylindrical enclosure can be used to store the first part of the case when the case is not in use, by collapsing and folding the first part to fit in the enclosure.

Any suitable form of connecting means may be provided, such as interengageable zippers around the opening in the first part, the open ends of the cylindrical parts, and the closed end of the second cylindrical part. To allow for the different arrangements of the parts, the zipper teeth around the opposite ends of the longer cylindrical part may be arranged to be closed in opposite directions, and the zipper tongues or zipper glider are preferably provided on the opening in the first part and the open end of the third cylindrical part.

In one embodiment of the invention the cylindrical parts of the case are of different lengths designed to hold a standard and a telescopic lens, or other different length lenses. Alternatively several cylindrical parts of the same or varying lengths may be provided, so that any combination of two cylindrical parts can be selected in order to carry the desired sizes of fitted and extra lens with the camera. Thus two lenses of the same or of different lengths may be carried as desired.

A separating zipper or other fastener is preferably provided along an upper face of the first part. Openings are provided at opposite ends of the zipper to allow a camera neck strap to pass through and out of the first part. This allows the camera case to be easily removed from or placed over the camera body, even when the neck strap is hanging around a person's neck, by simply releasing the zipper. A left hand glider separating zipper is preferably used on the upper face of the first part.

The first part preferably has wrap-over flaps which can be opened or closed when the zipper is open and which are secured together by interengaging portions of hook and loop material to define the opening. This aids in easy insertion or removal of a camera body.

Thus a versatile camera case is provided which allows more than one lens to be stored and which comprises several parts which are interconnectable in different ways to store a camera and two lenses, or to store a lens on its own while the camera is in use, or to store the parts together when not in use.

DESCRIPTION OF THE PREFERRED EMBODIMENT

Figure 1:
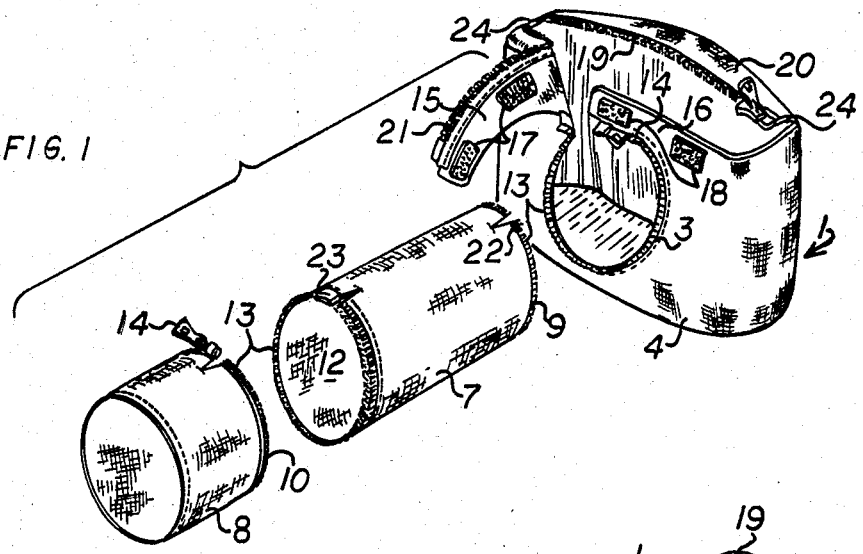
FIG. 1 is a perspective view showing the three parts of a camera case according to the invention when separated.
Figure 2:
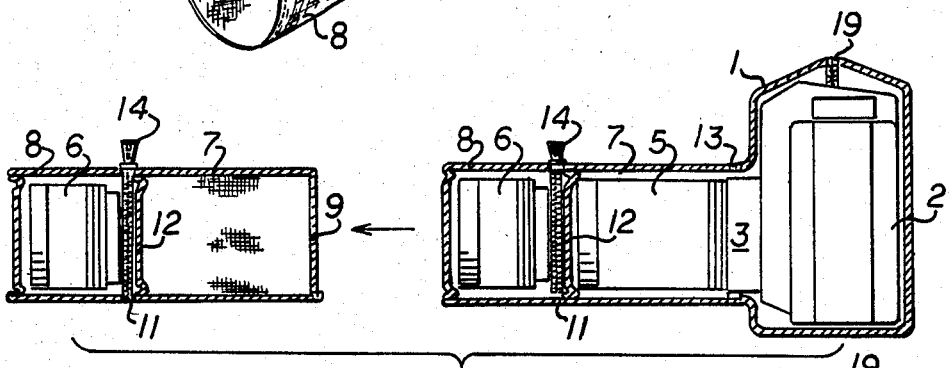
FIG. 2 is a vertical cross-section showing one arrangement for interconnecting the parts of the case to hold a camera and lenses.
Figure 3:
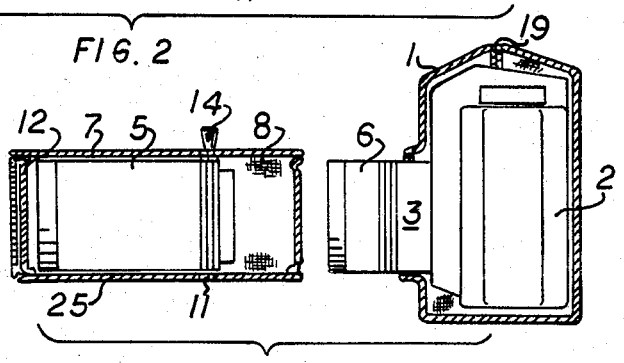
FIG. 3 is a vertical cross-section showing another arrangement of the parts of the case.
Figure 4:
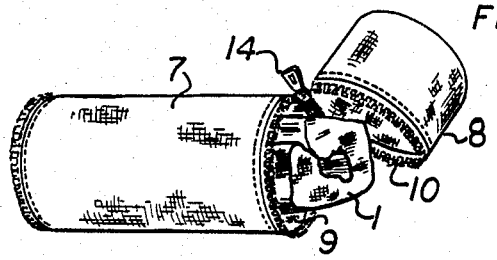
FIG. 4 is a side view of the parts of the case arranged for storage when they are not in use.

FIG. 1 shows the three interconnectable parts of a camera case according to the invention whih can be interconnected in various ways, as illustrated in FIGS. 2 to 4.

The case parts comprise a first part 1 shaped to hold the main body 2 of a camera (shown in outline in FIGS. 2 and 3) and having a central opening 3 in its front face 4 through which a camera lens 5, 6 can project (as shown in outline in FIGS. 2 and 3), and two cylindrical parts 7, 8 which are each open at one end 9, 10 only and which are of different lengths so as to fit over different size camera lenses. The parts 7, 8 may alternatively be the same length so as to carry camera lenses of the same length.

The various parts of the case can be selectively interconnected in various ways, as indicated in FIGS. 2 to 4, by means of interengageable zipper 11 or other securing devices provided around the opening 3 in the first part, the open ends 9, 10 of the cylindrical parts, and the closed end 12 of the longer cylindrical part 7.

As shown in the drawings, the opening 3 and the respective ends 9, 10, 12 of the parts 7 and 8 have cooperable zipper teeth 13 around their peripheries. The teeth 13 around the opposite ends of the part 7 are arranged to be closed in opposite directions. Zipper tongues or gliders 14 are provided on the teeth of opening 3 and the open end 10 of the cylindrical part 8. Thus either end of the part 7 can be zipped to the open end 10 of part 8 or to the opening 3. Both zipper gliders 14 rotate in a clockwise direction when viewed from the front of their respective openings.

The first part 1 of the case comprises a wrap-around envelope or cover which can easily be placed around or removed from a camera body 2. The front face 4 of the part 1 has wrap-over flaps 15, 16 at its upper edge which engage together to define the opening 3. The flaps are secured together by means of overlapping portions 17, 18 of interengaging hook and loop material, suitable Velcro (Registered Trade Mark). A separating zipper 19 extends across the upper face 20 of the part 1 to close the case when a camera body is enclosed by the flaps 15, 16. The teeth 21 along one half of the zipper 19 are formed along the upper edge of one of the flaps 15. Thus the flaps 15, 16 can be released once the zipper 19 has been opened. The zipper 19 is preferably left-handed, i.e. it closes in a right to left direction. This makes the part 1 very easy to open by right-handed people. The part 1 can be opened for removal of the camera by opening the zipper 19 and the flaps. The zipper 19 could be arranged in the opposite direction on cases for left-handed people.

The arrangement of the camera case parts to carry a camera and two lenses as shown in FIG. 2 will now be described. A telescopic lens 5 is attached to the camera body 2 in this example. The first part 1 of the camera case is placed over the camera body 2 with the zipper 19 open and the flaps 15, 16 released (as in FIG. 1). The flaps are then overlapped and the portions 16, 17 pushed together to secure them, with the telescopic lens 5 projecting out of the opening 3. The zipper 19 is then closed.

The longer cylindrical part 7 is then placed over the telescopic lens 5 so that the teeth 13 around the opening 3 and the open end 9 are adjacent. The tongue 14 is then engaged over the stop 22 provided on the open end 9, and the teeth 13 are zipped together by closing the slider around the opening 3.

The smaller lens 6 is placed into the smaller cylindrical part 8, and the open end 10 of this part is placed next to the closed end 12 of the part 7. The tongue 14 is engaged over the stop 23 on the teeth 13 of the closed end 12, and the adjacent ends are zipped together by closing the tongue 14 around their peripheries. With this arrangement of the parts tongues 14 on the opening 3 and open end 10 will rotate in opposite directions. The part 8 may be secured to the part 7 either before or after the part 7 is secured to the opening 3.

The camera body 2 and two lenses can thus be carried or stored together as one body, making transportation easier and reducing the risk of losing or damaging a lens. A strap (not shown) for carrying the camera can pass through open edges 24 provided for this purpose at opposite ends of the separating zipper 19. Thus the case can be removed for picture taking while the camera is still dangling from a strap around a person's neck, by simply releasing the zipper 19 and the flaps and pulling the case off the camera's body. This reduces the risk of dropping the camera and is much more convenient.

When the camera is to be used with the smaller or standard lens 6, the parts of the case can be arranged as shown in FIG. 3. The telescopic lens can be stored while not in use in a cylindrical enclosure 25 formed by zipping together the open ends 9, 10 of the parts 7 and 8,. The shorter lens can be attached to the camera body 2 so that it projects out of the opening 3. Thus the case parts also allow a telescopic lens to be safely stored and protected while the camera is in use. By providing extra cylindrical parts of the same or different length, with suitably arranged zippers, the case may be used to carry two lenses of the same length or of different lengths as desired.

FIG. 4 shows the arrangement of the parts for storage while not in use. The first part 1 of the case is folded or rolled up and stored in the cylindrical enclosure 25 formed by zipping the open ends of the cylindrical parts together.

The parts of the camera case may be formed of any suitable crushable or foldable material, such as fabric, soft leather, suede, or plastic material.

While the preferred embodiment of the invention has been described, other modifications may be made thereto and other embodiments may be devised without departing from the scope of the invention, which is defined by the appended claims.

What is claimed is:

1. A camera and lens case comprising in combination:

a camera body cover of crushable or foldable material for releasably covering a camera body, said cover comprising a top having a slot opening and slide fastening means for closing said opening, and a front having a circular opening for receiving a camera lens with first slide fastener means surrounding said opening, and flap means including releasable flap securing means defining an opening between said slot opening and said circular opening; and at least two cylindrical lens covers, each having a closed end and an open end and second slide fastener means surrounding the open end thereof and at least one of said lens covers having third slide fastener means surrounding the closed end, said second fastener means selectively cooperating with said first slide fastener means for covering a lens on a camera in said camera body cover and with said third fastener means for supporting another lens on the end of said one cover.

2. A cover according to claim 1 wherein said lens covers are of different lengths to accommodate different length lenses.

3. A cover according to claim 1 wherein said slot opening and said slide fastening means define openings at the ends of the slot for releasable closing around a camera support strap attached directly to a camera body in said cover.

4. A cover according to claim 3 wherein said flap means includes an overlapping flap defining an upper part of said front, one side of said slot and a portion of said lens opening for enabling removal of said cover from an independently strap supported camera body contained in said cover.

5. The camera case of claim 4, wherein said flap securing means comprise overlapping lengths of hook and loop fastener material.

6. A combination of a camera and lens case for an independently strap supported multiple lens camera, said case comprising:

a first collapsible cover of pliable material of a generally box-like configuration for releasably covering an independently strap supported camera body, said cover defining bottom, back, side, front and top, said top having a slot opening with slide fastening means for closing said slot opening, said front including overlapping flap means defining a generally circular opening for extension of a lens and including releasable flap securing means for opening said circular opening to said slot opening;

first slide fastening means surrounding said circular opening;

at least two collapsible cylindrical lens covers formed of pliable material, each having an open end and a closed end and second slide fastening means surrounding said open end for engaging said first slide fastening means for covering a lens on a camera body in said cover; and one of said lens covers having third slide fastening means around the closed end thereof for engaging said second slide fastening means of the other of said lens covers for supporting another lens on the end of said other of said lens covers.

7. A combination according to claim 6 wherein said first cover is storable in said lens covers.

8. A combination according to claim 6 wherein said first, said second, and said third slide fastening means are interchangeably innerconnectable with one another.

* * * * *